US005550557A

United States Patent [19]

Kapoor et al.

[11] Patent Number: 5,550,557

[45] Date of Patent: Aug. 27, 1996

[54] SYMMETRIC DRIVE FOR AN ELECTROLUMINSCENT DISPLAY PANEL

[75] Inventors: Mohan L. Kapoor, Orange; Thomas J. Rebeschi, North Haven, both of Conn.

[73] Assignee: Northrop Grumman, Los Angeles, Calif.

[21] Appl. No.: 358,044

[22] Filed: Dec. 15, 1994

Related U.S. Application Data

[63] Continuation of Ser. No. 241,950, May 12, 1994, abandoned, which is a continuation of Ser. No. 133,811, Oct. 8, 1993, abandoned, which is a continuation of Ser. No. 906,605, Jun. 30, 1992, abandoned.

[51] Int. Cl.[6] ..... G09G 3/30

[52] U.S. Cl. ..... 345/76; 345/212

[58] Field of Search ..... 340/781, 811, 340/767, 805, 719; 315/169.1, 169.3, 219, 244, 307; 345/76, 77, 78, 80, 45, 211, 212

[56] References Cited

U.S. PATENT DOCUMENTS 4,958,105 9/1990 Young et al. ..... 340/781

5,027,036 6/1991 Ikarashi et al. ..... 340/781

5,027,040 6/1991 Ikeda et al. ..... 315/169.3

5,144,203 9/1992 Fujita et al. ..... 315/169.3

*Primary Examiner*—Jeffery Brier

*Assistant Examiner*—Chanh Nguyen

*Attorney, Agent, or Firm*—C. O. Edwards

[57] ABSTRACT

A power supply for providing a symmetric drive for an AC electroluminescent (EL) display panel includes a single power supply which provides two voltage signal values of opposite polarity $V_{pos}$,$V_{neg}$ to the panel's row drivers. The supply also corrects the difference between the two voltage signal values $V_{pos}$,$V_{neg}$ as a function of the difference between the maximum column driver voltage value $V_{col}$ and its nominal value to reduce latent images on the display panel. By utilizing a single switching regulator to generate the opposite polarity row voltages $V_{pos}$,$V_{neg}$ the circuit complexity and cost associated with providing a symmetric drive for an EL panel is reduced.

1 Claim, 4 Drawing Sheets

FRAME 1
FRAME 2
TIME
50
52
53
54
56
57
58
59
60
61
48
T
$t_1$
$t_2$
$t_3$
$t_4$
$t_5$
210
-160
ROW VOLTAGE (VDC)

TIME
62
64
66
68
70
$t_1$
$t_2$
$t_3$
$t_4$
$t_5$
50
40
30
20
10
COLUMN VOLTAGE (VDC)

TIME
72
74
76
78
80
$t_1$
$t_2$
$t_3$
$t_4$
$t_5$
200
100
0
-100
-200
PIXEL VOLTAGE (VDC)

SYMMETRIC DRIVE FOR AN ELECTROLUMINSCENT DISPLAY PANEL

This is a continuation of application Ser. No. 08/241,950 filed May 12, 1994, now abandoned, which is a continuation of application Ser. No. 08/133,811, filed Oct. 8, 1993, now abondoned, which is a continuation of application Ser. No. 07/906,605, filed Jun. 30, 1992, now abondoned.

CROSS REFERENCE TO RELATED APPLICATIONS

This application contains subject matter related to commonly assigned co-pending application, attorney docket N-1205, Ser. No. 07/960,595, entitled "Gray-Scale Stepped Ramp Generator With Individual Step Correction" filed even date herewith.

TECHNICAL FIELD

This invention relates to electroluminescent displays, and more particularly to an improved symmetric display drive.

BACKGROUND ART

The operation of an AC thin film electroluminescent (TFEL) display panel is based on the principle that a luminescent material (e.g., phosphor) will emit light when a voltage of sufficient magnitude is applied across it. The TFEL display is typically constructed with luminescent material sandwiched between a dielectic insulator and a plurality of row electrodes on one side, and a plurality of column electrodes on the opposite side. Each intersection of the plurality of row and column electrodes defines a pixel. A typical high resolution TFEL display panel may have 512 row electrodes and 640 column electrodes, resulting in 327,680 pixels. Commonly assigned U.S. application, Ser. No. 07/897,201, attorney docket number R-3612N, entitled "Low Resistance, Thermally Stable Electrode Structure for Electroluminescent Displays" filed Jun. 11, 1992, discloses the construction of a TFEL display panel.

The luminance of each pixel in the panel is dependent upon the magnitude of the voltage applied across the particular row and column electrode which define the pixel. As a result of this relationship, gray shading can be achieved by controlling the magnitude of the voltage across the pixel. As an example, each pixel may display one of sixteen luminance levels depending on the magnitude of the voltage applied across the pixel. The magnitude of the minimum voltage required across the pixel before the electroluminescent material will display light is often referred to as the threshold voltage.

A problem with a TFEL display panel is that it often suffers from latent imaging problems which cause ghost images on the display panel. This is typically a result of the pixel's voltage-time average being non-zero when averaged over several scans through the panel.

U.S. Pat. No. 4,975,691 to J. Y. Lee entitled "Scan Inversion Symmetric Drive" discusses the problem of latent images and discloses alternating the order the rows are scanned in an attempt to reduce the latent images. More particularly the '691 patent discloses the steps of first applying a refresh pulse of a first polarity (e.g.,–160) to all the rows in the panel, then sequencing through each row of the panel updating the pixels one row at a time. Once all the rows have been addressed, the refresh pulse of the first polarity is applied again for a short duration, and rows are again scanned through but this time in the reverse order of the previous scan. A problem with this approach is that is does not utilize the advantages of gray-scaling and hence is not subject to the problems therewith.

U.S. Pat. No. 4,733,228 to R. T. Flegal entitled "Transformer-Coupled Drive Network For A TFEL Panel" also discloses a symmetric drive scheme for reducing latent image problems. The '228 patent discloses sequentially scanning through all the rows and applying a voltage of a first polarity (e.g., –160 vdc) on the row electrodes, and on the next scan through applying a voltage of a second polarity (e.g., 210 vdc). A modulation voltage is then applied to the column electrodes to control pixel luminance. The symmetric drive is achieved by reversing the polarity of the row driver voltage each frame, and separating the row voltages by an amount equal to the magnitude of the column modulation voltage value. A problem with this approach is that it fails to provide a symmetric drive scheme for a panel employing gray scaling. Another problem is the circuit complexity and cost associated with providing dual polarity row drivers.

SUMMARY OF THE INVENTION

An object of the present invention is to provide an improved symmetric drive for an electroluminescent (EL) display panel which reduces latent images on the display panel.

Another object of the present invention is to reduce latent images on an EL display panel which employs gray scaling.

Yet another object of the present invention is to provide an improved symmetric drive with reduced circuit cost and complexity capable of supporting gray scaling for an EL panel.

According to the present invention, an improved symmetric drive for an electroluminescent display panel includes a single power supply which provides two voltage signal values of opposite polarity $V_{pos}$,$V_{neg}$, and corrects the difference between the two voltage signal values $V_{pos}$,$V_{neg}$ as a function of the difference between the maximum column driver voltage value $V_{col}$ and its nominal value.

The present invention utilizes a single power supply having a single switching regulator to generate the opposite polarity row voltages which significantly reduces the circuit complexity and cost associated with providing a symmetric drive for an EL panel.

These and other objects, features and advantages of the present invention will become more apparent in light of the following detailed description of a best mode embodiment thereof as illustrated in the accompanying drawings.

BEST MODE FOR CARRYING OUT THE INVENTION

Figure 1:
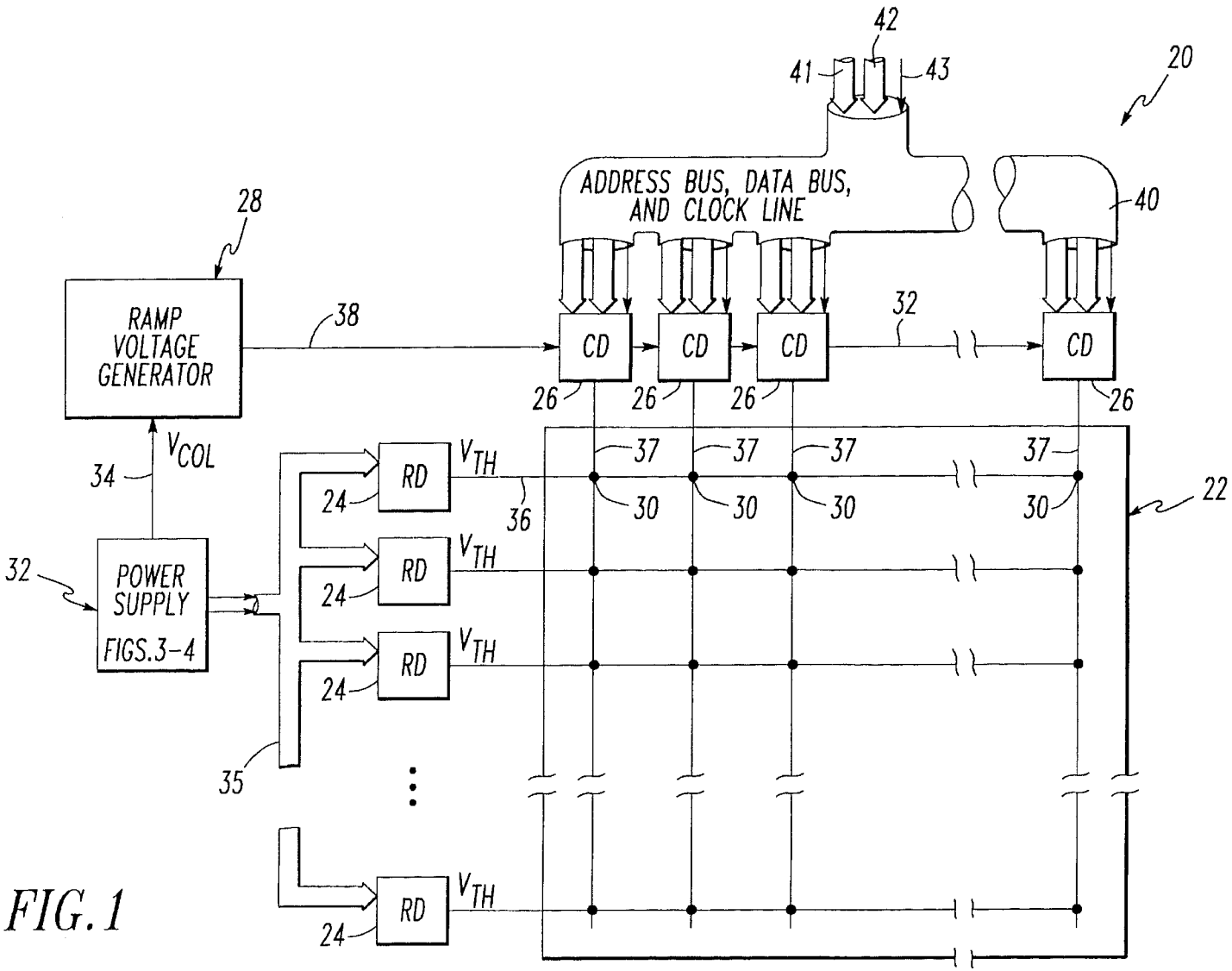
FIG. 1 is a block diagram of an AC electroluminescent display panel and its associated drive circuitry.

Referring to FIG. 1, a thin film electroluminescent (TFEL) display panel system 20 capable of gray scaling includes a TFEL display panel 22, a plurality of row drivers 24, a plurality of column drivers 26, and a ramp voltage generator 28. A power supply 32 provides a maximum column driver voltage signal $V_{col}$ on a line 34 to the ramp voltage generator 28. The power supply 32 also provides two voltage signal values $V_{pos}$ and $V_{neg}$ to each of the plurality of row drivers 24 via a bus 35.

The display panel 22 is driven in a well known manner utilizing a row-at-a-time drive scheme where a voltage equal to the threshold voltage is placed on an electrode 36. This allows the luminance of individual pixels 30 in the row to be independently controlled by regulating the magnitude of the voltage placed on each of the plurality of column electrodes 37. The next scan through the panel a voltage of equal magnitude but opposite polarity is applied to each pixel in the row. A detailed explanation on how the panel is symmetrically driven will be presented hereinafter.

To control the column driver voltage, the ramp voltage generator 28 typically provides a ramped voltage signal on a line 38 to each of the plurality of column drivers 26. The signal on the line 38 typically ramps over a fixed duration from zero vdc to a voltage equal to the maximum column driver voltage signal value $V_{col}$ on the line 34. Each of the column drivers 26 operates as a sample-and-hold device and receives the ramped voltage signal on the line 38, samples it at a predetermined time and retains (i.e., holds) the sampled voltage signal value. The column drivers interface with a controller (not shown) via a bus 40 which contains address, data, and clock lines 41–43 respectively. Each column driver can sample the ramped voltage signal on the line 38 at a different time, and the instant each column driver samples the signal is controlled by the value each receives over the data lines 42. This allows the luminance of the individual pixels 30 to be independently controlled by regulating the magnitude of the voltage placed on each of the plurality of column electrodes 37. The procedure is repeated for each row of pixels, and in general is repeated indefinitely while the panel is powered and displaying information. Co-pending application filed even date herewith, Ser. No. 07/906,595, filed Jun. 30, 1992 now abandoned, and entitled "Gray-Scale Stepped Ramp Generator With Individual Step Correction" discloses a stepped ramp generator.

Figure 2A:
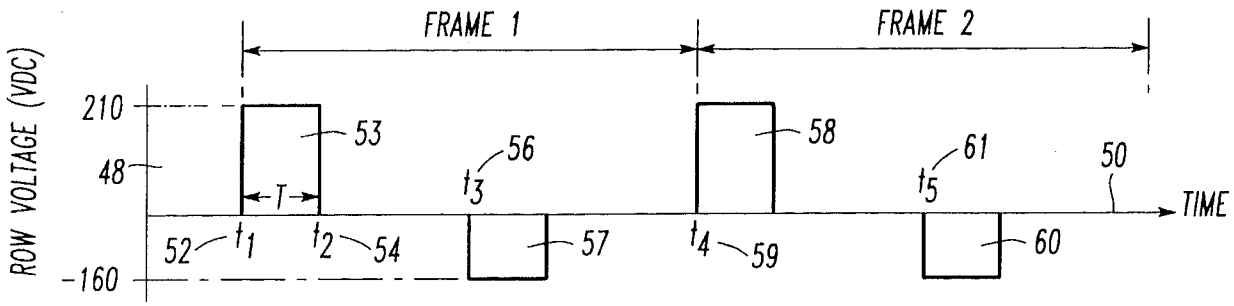
FIGS. 2A,2B and 2C illustrate the voltages applied by a row driver, a column driver and the resultant voltage across the pixel for several scans through the display panel of FIG. 1.
Figure 2B:
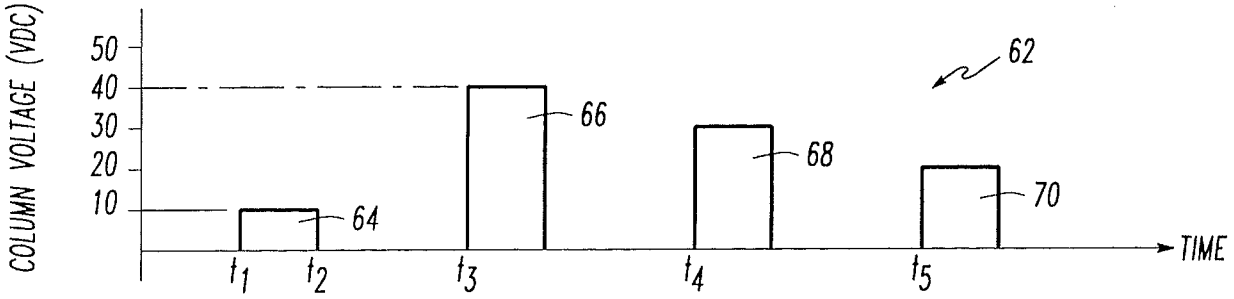
Figure 2C:
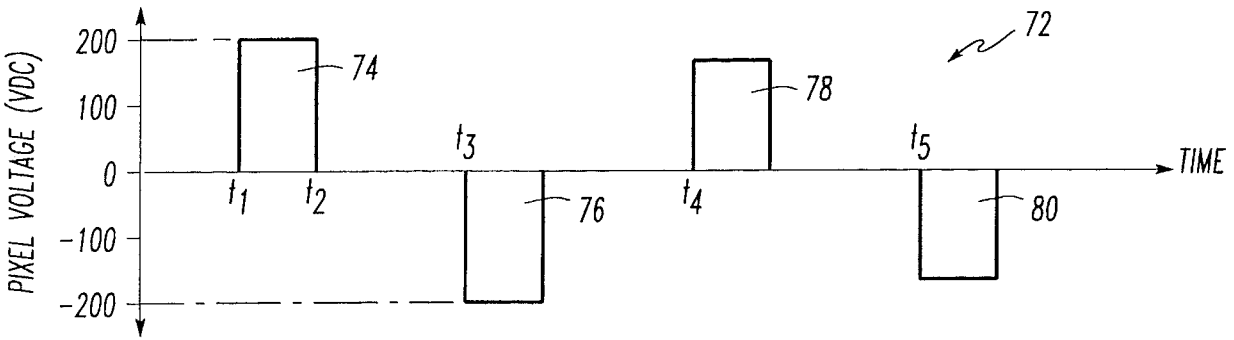

To illustrate a symmetric drive scheme, FIGS. 2A, 2B and 2C plot the row voltage, column voltage and the voltage across one of the plurality of pixels 30 over a two frame period. FIG. 2A is a plot of row voltage on a vertical axis 48 versus time along a horizontal axis 50. At time equal $t_1$ 52 the row driver applies a positive 210 vdc pulse 53 on the row electrode 36. A fixed time T later at time $t_2$ 54 the row driver applies a voltage of approximately zero vdc while the remaining rows are sequentially scanned through. At time $t_3$ 56 the second scan through the panel 22 begins and a −160 vdc pulse 57 is placed on the row electrode 36. Fixed time T later, the voltage on the row electrode 36 is switched to zero vdc until the row driver again applies a positive voltage pulse 58 at time $t_4$ 59 to start the third scan through the panel and initiate frame 2. During the fourth scan a negative voltage pulse 60 is applied at time $t_5$ 61 to row electrode 36. Attention is drawn to the fact positive pulses 53,58 are essentially identical, as are the negative pulses 57,60.

FIG. 2B is a plot 62 of the column voltage for one of the plurality of column drivers 26 versus time. Time is plotted on the same time scale used FIG. 2A. In the interest of clarity, plot 2B has been simplified to show only the column voltages associated with the row corresponding to FIG. 2A, that is row electrode 36. At time $t_1$ the column driver applies a ten vdc pulse 64 to the column electrode, and at time $t_2$ the column driver sets the electrode voltage equal to zero as it prepares to scan another row. During the second scan through the row at time $t_3$ the column driver applies a forty vdc pulse 66. At time $t_4$ frame 2 starts and the column driver applies a thirty vdc pulse 68, followed by the application of a twenty vdc pulse 70 at time $t_5$. The net result of applying this combination of row and column voltage pulses in illustrated in FIG. 2C.

FIG. 2C is a plot 72 of the voltage across the pixel corresponding to the row and column drivers associated with FIGS. 2A and 2B respectively. The time scale in FIG. 2C matches the scale used in FIGS. 2A and 2B. Voltage across the pixel at any given time is defined as the difference between the row and column voltages. As an example, at time $t_1$ a 200 vdc pulse 74 is applied across the pixel which represents the difference between the 210 vdc pulse 53 on the row, and the 10 vdc pulse 64 on the column. During the second scan through at time $t_3$ the row driver applies the −160 vdc pulse 57, and the column driver applies the 40 vdc pulse 66; the net effect is a −200 vdc pulse 76 across the pixel. At the start of frame 2 at time $t_4$ the voltage across the pixel is a 180 vdc voltage pulse 78, indicative of the voltage difference between the 210 vdc row pulse 58 and the 30 vdc column pulse 68. At time $t_5$ the magnitude of a voltage pulse 80 across the pixel is again 180 vdc, but now with a negative polarity. Different voltage magnitudes were used in frames 1 and 2 to illustrate how the voltage across a pixel may vary as a result of gray scaling. Attention is drawn to fact that the average dc voltage across the pixel in both frames 1 and 2 is zero since pulses 74,76 over frame 1, and pulses 78,80 over frame 2 are symmetrical. As a result, the latent images on the panel are reduced as confirmed in practice. Having observed the details of the voltage pulses that must be applied for a symmetric drive, attention may now be given to the circuitry which provides these pulses to the row and column drivers.

Figure 3:
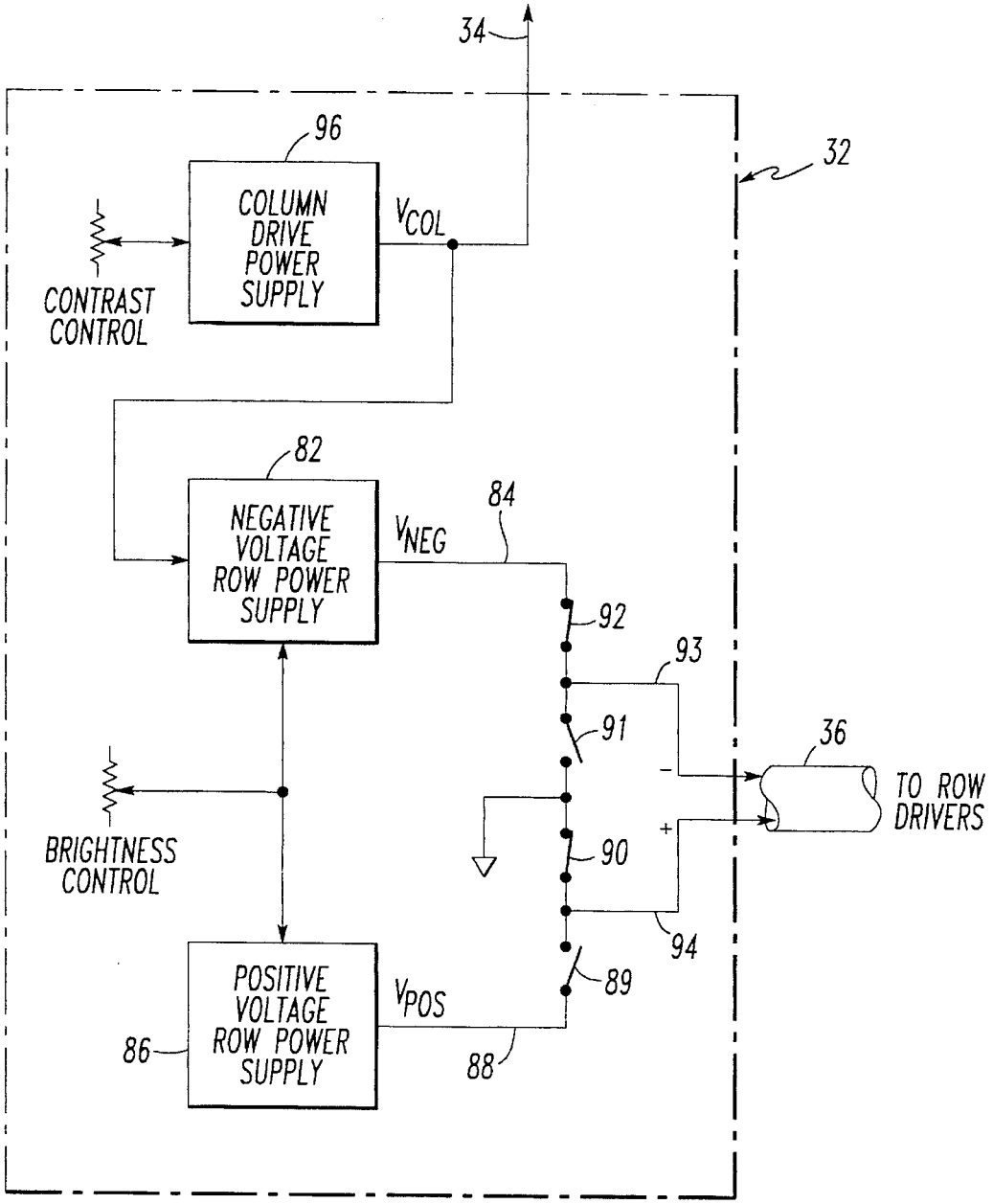
FIG. 3 PRIOR ART
FIG. 3 is a block diagram of a prior art power supply capable of symmetrically driving the display panel of FIG. 1.

FIG. 3 is a prior art embodiment of the power supply 32 for generating the positive and negative voltage signals $V_{pos}$,$V_{neg}$ respectively for the row drivers, and the maximum column driver voltage signal $V_{col}$ for the ramped voltage generator. A negative voltage power supply 82 provides a negative row voltage signal $V_{neg}$ (e.g., −160) on a line 84, and a positive voltage power supply 86 provides a positive row voltage signal $V_{pos}$ (e.g., 210 vdc) on a line 88. A series of four switches 89–92 control the voltage value across lines 93,94. As an example if switches 90,92 are closed and switches 89,91 are opened as illustrated, then −160 vdc is provided across the lines 93,94. Similarly, if switches 90,92 are opened and switches 89,91 are closed, 210 vdc is provided across the lines 93,94. A column driver power supply 96 provides a signal indicative of the maximum column voltage $V_{col}$ (e.g., 50 vdc) on the line 34.

To ensure the net dc voltage across each pixel remains zero every frame, the signal $V_{col}$ on the line 34 is input to the negative voltage row power supply 82 so the difference in the magnitude between $V_{neg}$ and $V_{pos}$ can be adjusted to correct for variations in the value of $V_{col}$. For example, assuming $V_{col}$ is typically 50 vdc but varies to 52 vdc due to drift or to operator adjustment to display constrast, the difference between the magnitudes of $V_{pos}$ and $V_{neg}$ have to be adjusted from their nominal separation of 50 vdc to 52 vdc in order to correct for the drift in $V_{col}$. The adjustment is accomplished by providing the negative row power supply 82 with the signal on the line 34 so $V_{neg}$ can be offset from its nominal value (i.e., −160 vdc) an amount equal to the value $V_{col}$ has drifted from nominal. A problem with this prior art power supply is that it requires a dual power supply architecture (i.e., supplies 82,86) to generate $V_{pos}$ and $V_{neg}$ for the row drivers 24 (FIG. 1).

Figure 4:
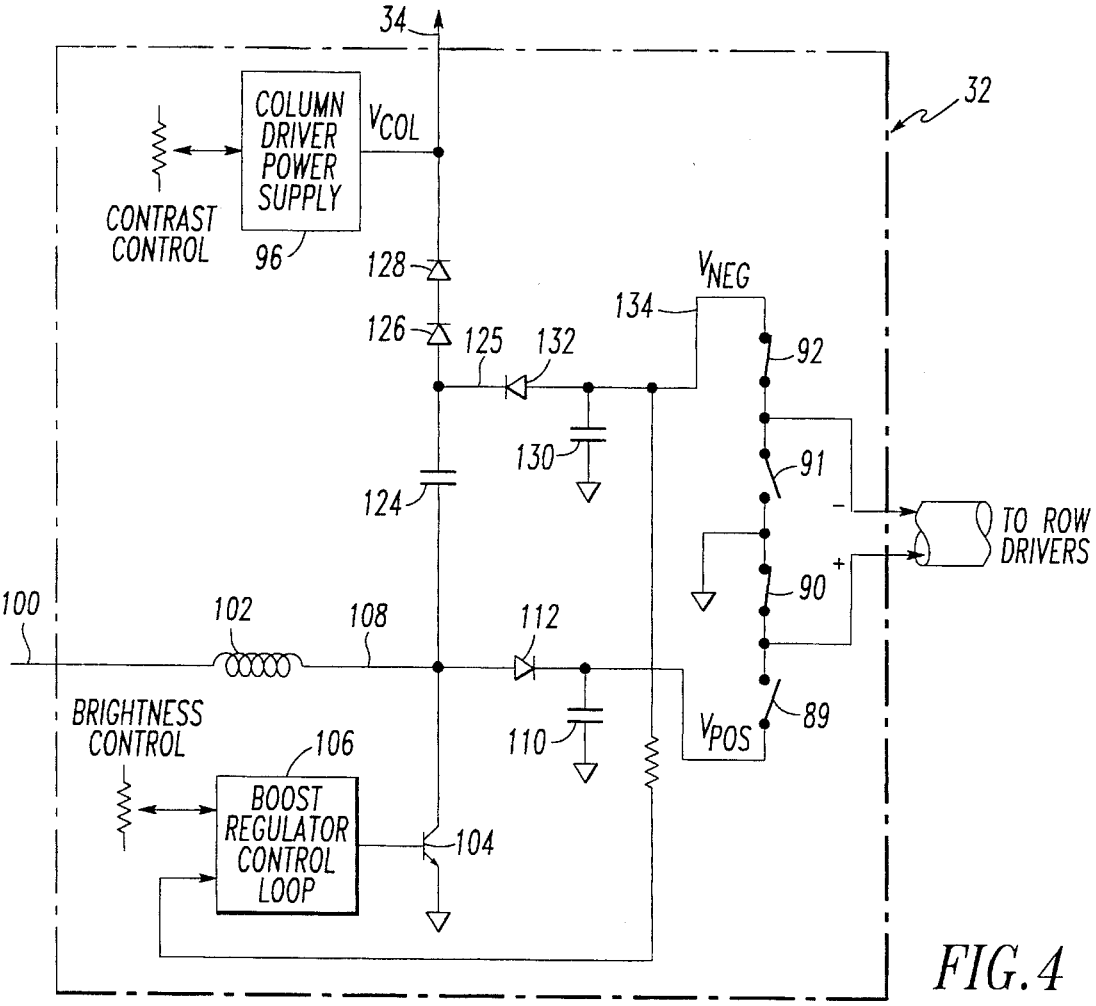
FIG. 4 is a schematic diagram of a power supply according to the present invention.

FIG. 4 is a block diagram of the improved power supply of the present invention. This improved power supply requires only one row power supply from which both the positive and negative row voltage signal values $V_{pos}$ and $V_{neg}$ are derived. The power supply receives an unregulated dc voltage signal on a line 100 which is input to an inductor 102. A transistor 104 operates as a switch under the control of a pulse width modulated boost regulator 106. While the transistor 104 is in saturation (analogous to a switch being closed) energy builds in the inductor 102, and when the transistor 104 is switched into cutoff (analogous to the switch opening) energy is transferred from the inductor 102 along a line 108 to capacitor 110 via a diode to provide the voltage signal $V_{pos}$ on a line 114. The capacitor 110 and diode 112 operate to filter and peak detect the signal on the line 108 and provide the dc signal $V_{pos}$ on the line 114. The switches 89–92 control the voltage measured across lines 114,134 in the same manner as disclosed hereinbefore with respect to FIG. 3.

As known in the art of power supply design, the magnitude of the voltage signal $V_{pos}$ on the line 114 is determined by the ratio of time (i.e., the duty-cycle) the transistor 104 is in saturation. As a result, $V_{pos}$ can be expressed as:

$$V_{pos}=V_{in}/[1-(T_{on}/(T_{on+Toff}))] \quad \text{Eq.1}$$

where:

$T_{on}$=the % of time transistor 104 is in saturation;

$T_{off}$=the % of time transistor 104 is in cut-off; and $V_{in}$=the signal on the line 100.

Figure 5:
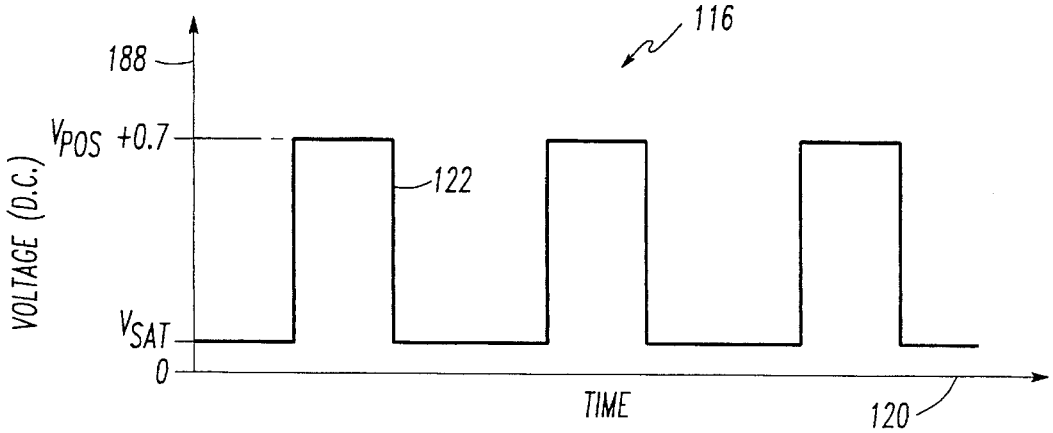
FIG. 5 is a graph of the voltage on a line of the power supply of FIG. 4.

FIG. 5 is a plot 116 of voltage on the line 108 (FIG. 4) as a result of switching the transistor 104 between cut-off and saturation. Voltage is plotted along a vertical axis 118 and time is plotted along a horizontal axis 120. Voltage on the line 108 (FIG. 4) varies along a line 122 to create a square wave having a minimum voltage of the transistor saturation voltage $V_{sat}$ (e.g., 50 millivolts), and a maximum of ($V_{pos}$+0.7 vdc) where the 0.7 vdc represents the forward voltage drop across the diode 112. To maintain a constant voltage $V_{pos}$ on the line 114, the regulator 106 controls the duty cycle of the square wave signal on the line 108. Referring again to FIG. 4, along with transferring energy to the capacitor 110, energy from the inductor 102 is AC coupled by a capacitor 124 along a line 125 to diodes 126,128, and to a capacitor 130 which is charged through diode 132 to provide the voltage signal $V_{neg}$ on a line 134. The capacitor 130 and diode 132 filter and peak detect the signal on the line 125 and provide the dc signal value $V_{neg}$ on the line 134. Diodes 126,128 clamp the positive transition of the signal on the line 125 to the value of the signal $V_{col}$ on the line 34. The present invention is best understood by deriving the equation for the signal $V_{neg}$ on the line 134. First write the equation for the differential voltage on the line 108:

$$V_1=V_{pos}+D_1-V_{sat} \quad \text{Eq.2}$$

where:

$V_1$=differential voltage on the line 108;

$V_{pos}$=voltage on the line 114;

$D_1$=voltage drop across diode 112; and $V_{sat}$=transistor 104 saturation voltage.

The equation for the differential voltage on the line 125 can be written as:

$$V_2=V_{col}+D_2+D_3-V_1 \quad \text{Eq. 3}$$

where:

$V_2$=differential voltage on the line 125;

$V_{col}$=voltage on the line 34;

$D_2$=voltage drop across diode 126; and $D_3$=voltage drop across diode 128.

The equation for voltage signal value $V_{neg}$ on the line 134 can be written as:

$$V_{neg}=-V_2+D_4 \quad \text{Eq. 4}$$

where:

$D_4$=voltage drop across the diode 132.

Substituting Eq. 3 in to Eq. 4 yields:

$$V_{neg}=-(V_{col}+D_2+D_3-V_1)+D_4 \quad \text{Eq. 5}$$

Now substitute Eq. 2 into Eq. 5, which yields:

$$V_{neg}=-V_{col}-D_2-D_3+(V_{pos}+D_1-V_{sat})+D_4 \quad \text{Eq. 6}$$

Assuming all the diode voltage drops are equal, the expression for $V_{neg}$ can be written as:

$$V_{neg}=V_{pos}-(V_{col}+V_{sat}) \quad \text{Eq. 7}$$

As a result, Eq. 7 demonstrates that the voltage signal value $V_{neg}$ on the line 134 is equal to $V_{pos}$ less the column voltage signal value $V_{col}$ on the line 34 and the saturation voltage of the transistor 104, assuming the voltage drops across the diodes are equal. This demonstrates that as $V_{col}$ varies $V_{neg}$ is automatically compensated. Furthermore it is found in practice that if $V_{sat}$ is less than fifty millivolts and the diodes are all matched to within fifty millivolts, the worst case offset that will occur between the actual and desired row voltages is 150 millivolts.

Having observed the details of the operation of the improved power supply in FIG. 4, attention is drawn to the simplicity of the power supply of the present invention for driving an symmetrically driving EL panel. In addition, the variation in $V_{col}$ is automatically compensated for while maintaining the ideal difference between $V_{pos}$ and $V_{neg}$ to within 150 millivolts. The overall power supply efficiency is also improved since only a single switching regulator is required to generate both the positive and negative outputs $V_{pos}$,$V_{neg}$.

It should be understood the present invention is not limited to the specific embodiment herein, nor by the exemplary voltage values disclosed herein. Rather one of ordinary skill in the art will recognize variations of the exemplary power supply of the present invention for providing a symmetric drive for an EL panel. As an example the diodes may be replaced with properly designed transistor networks, and active components may be used to replace several of the passive devices illustrated in FIG. 4.

However the foregoing changes and variations are irrelevant to the invention, it suffices that a symmetric drive for an electroluminescent display panel is provided by a power supply system having a single switching regulator from which two voltage signal values of opposite polarity $V_{pos}$, $V_{neg}$ are generated. The power supply system also automatically corrects the voltage difference between $V_{pos}$,$V_{neg}$ as a function of variations in the maximum column driver voltage $V_{col}$.

Although the present invention has been shown and described with respect to a best mode embodiment thereof, it should be understood by those skilled in the art that various other changes, omissions and additions to the form and detail thereof, may be made therein without departing from the spirit and scope of the present invention.

We claim:

1. An electroluminescent display panel power supply which generates two voltage values of opposite polarity $V_{pos}$,$V_{neg}$ by using a single switching regulator, for an electroluminescent display panel, said power supply comprising:

a first node;

a second node;

third node;

a fourth node;

means for providing a regulated maximum column driver voltage signal value $V_{col}$;

an inductor having a first terminal which receives a DC voltage signal value, and a second terminal connected to said first node;

a first diode having an anode connected to said first node and a cathode connected to said second node;

a first capacitor having a first terminal connected to said second node and a second terminal connected to a fixed voltage signal value;

a second capacitor having a first terminal connected to said first node and a second terminal connected to said third node;

a second diode having an anode connected to said third node;

a third diode having a cathode connected to said third node and an anode connected to said fourth node;

a third capacitor having a first terminal connected to said fourth node and a second terminal connected to said fixed voltage signal value;

a single switching regulator which receives a feedback signal from said fourth node and provides a voltage control signal on a control line;

a transistor having a collector terminal connected to said first node, a base terminal connected to said control line and an emitter connected to a fixed voltage signal value; and a fourth diode having an anode connected to said cathode of said second diode, and a cathode connected to said column driver voltage signal value $V_{col}$, wherein said $V_{pos}$ is provided on said second node and said $V_{neg}$ is provided on said fourth node.

* * * * *